United States Patent [19]

Takaki et al.

[11] Patent Number: 4,728,596

[45] Date of Patent: Mar. 1, 1988

[54] LIGHT-SENSITIVE ELEMENT FOR SILVER SALT DIFFUSION TRANSFER WITH IODINE TRAPPING LAYER

[75] Inventors: Hideki Takaki; Yukio Karino; Noriyuki Inoue, all of Kanagawa, Japan

[73] Assignee: Fuji Photo Film Co., Ltd., Kanagawa, Japan

[21] Appl. No.: 821,354

[22] Filed: Jan. 22, 1986

[30] Foreign Application Priority Data

Jan. 22, 1985 [JP] Japan ..... 60-9345
Jan. 29, 1985 [JP] Japan ..... 60-14956

[51] Int. Cl.[4] ..... G03C 5/54

[52] U.S. Cl. ..... 430/248; 430/227; 430/230; 430/233; 430/523; 430/536

[58] Field of Search ..... 430/227, 230, 232, 233, 430/202, 213, 214, 217, 523, 536, 244, 248

[56] References Cited

U.S. PATENT DOCUMENTS

| | | | |
|---|---|---|---|
| 3,619,186 | 11/1971 | Parsons | 430/233 |
| 3,708,300 | 1/1973 | Luckey | 430/217 |
| 3,958,995 | 5/1976 | Campbell et al. | 430/213 |
| 4,015,989 | 4/1977 | Oishi et al. | 430/214 |
| 4,131,469 | 12/1978 | Miyazako et al. | 430/213 |

*Primary Examiner*—Richard L. Schilling
*Attorney, Agent, or Firm*—Sughrue, Mion, Zinn, Macpeak and Seas

[57] ABSTRACT

A light-sensitive element for the silver salt diffusion transfer method is described, comprising a support bearing thereon at least a light-sensitive silver halide emulsion layer containing silver iodide, wherein at least one layer for trapping on iodide ion is provided between the support and the emulsion layer. This light-sensitive element provides a silver image which is improved in fading and discoloration during storage.

6 Claims, No Drawings

LIGHT-SENSITIVE ELEMENT FOR SILVER SALT DIFFUSION TRANSFER WITH IODINE TRAPPING LAYER

FIELD OF THE INVENTION

The present invention relates to a photographic element for the silver salt diffusion transfer method. More particularly, it is concerned with a light-sensitive element for use in the silver salt diffusion transfer method.

BACKGROUND OF THE INVENTION

The diffusion transfer photographic method utilizing silver halide, for example, has been known. In accordance with this method, a light-sensitive element containing an exposed silver halide photographic emulsion is superposed on an image-receiving element containing a silver-precipitating agent and then an alkaline processing solution containing a solvent for silver halide is introduced between the light-sensitive and image-receiving elements in the presence of a developing agent, whereupon a positive silver image pattern is formed directly on the image-receiving element.

In this method, the unexposed silver halide emulsion is dissolved in the silver halide solvent and, as a silver ion complex, introduced in the alkaline processing solution. Thereafter, it is transferred to the image-receiving element and precipitated therein in the silver image pattern by the action of the silver-precipitating agent, resulting in the formation of the direct positive image.

However, the silver image pattern thus formed in the image-receiving element has a disadvantage in that it is readily discolored or fades during the storage.

In order to overcome the above defect, an improved method has been proposed, as described in Japanese Patent Publication No. 5392/71, U.S. Pat. No. 3,533,789, and British Pat. No. 1,164,642, in which a water-soluble polymer solution containing an alkali-neutralizing component is coated on the surface of the silver image. This improved method, however, still has disadvantages in that it takes a long time until the aqueous polymer solution coating completely dries and, during this period, the coating surface is adhesive and sticky, such that fingerprints or dust often attach thereto. Moreover, it is troublesome to coat such a solution on the silver image pattern.

Japanese Patent Publication No. 44418/81 discloses an image-receiving element comprising (1) a cellulose ester, polyvinyl ester, or polyvinyl acetal layer containing a compound which is diffusible and capable of changing the properties of the silver image, said layer being hydrolyzable and upon hydrolysis, becoming permeable to alkalis, and (2) a regenerated cellulose layer containing a silver-precipitating agent. Furthermore, as the compound which is diffusible and capable of changing the properties of the silver image, organic mercapto compounds are described.

Japanese Patent Publication No. 21140/81 and Japanese Patent Application (OPI) No. 500431/81 (the term "OPI" as used herein means a "published unexamined Japanese patent application") disclose that the silver image is prevented from fading by application of noble metal compounds onto the silver image.

These compounds, however, fail to sufficiently stabilize the silver image obtained by the diffusion transfer method. That is, even if the compounds are added, discoloration and fading inevitably occur. It has therefore been desired to develop a novel element having increased stability of the silver image.

SUMMARY OF THE INVENTION

An object of the present invention is to provide a novel photographic element for use in the silver salt diffusion transfer method.

Another object of the present invention is to provide a novel silver halide light-sensitive material for use in the silver salt diffusion transfer method.

Still another object of the present invention is to provide a photographic print by the diffusion transfer method, in which a silver image is improved with respect to discoloration and fading during storage.

As a result of extensive investigations on a light-sensitive element comprising a support and a light-sensitive silver halide emulsion layer containing at least silver iodide, it has been found that the above objects can be attained by providing at least one layer for trapping an iodide ion between the support and the emulsion layer.

Accordingly, the light-sensitive element for the silver salt diffusion transfer method according to the present invention comprises a support and a light-sensitive silver halide emulsion layer containing at least silver iodide provided on the support, and at least one layer capable of trapping iodide ions is provided between the support and the light-sensitive silver halide emulsion layer.

DETAILED DESCRIPTION OF THE INVENTION

The light-sensitive element of the present invention comprises a support having thereon at least two layers. More specifically, the light-sensitive element comprises a support bearing thereon at least a light-sensitive silver halide emulsion layer and a layer trapping an iodide ion of the present invention.

In a preferred embodiment of the present invention, the photographic element for use in the silver salt diffusion transfer method comprises (a) a light-sensitive element comprising a support and a light-sensitive silver halide emulsion layer containing silver iodide provided on the support and (b) an image-receiving element comprising a support and an image-receiving layer containing a silver-depositing agent, wherein, in the light-sensitive element (a), at least one layer capable of trapping iodide ions is provided between the support and the image-receiving layer.

One example of the layer capable of trapping iodide ions is a layer containing a cationic polyelectrolyte not containing iodide ions as counter ions.

Examples of the cationic polyelectrolyte include quaternary ammonium, sulfonium and phosphonium polymers. Of these compounds, quaternary ammonium and phosphonium polymers are preferred. These cationic polyelectrolytes are described, for example, in M. Fred Hoover, *Journal of Macromolecule Science*, A4(6), pp. 1327–1417 (1970). In addition, latexes in water as described in Japanese Patent Application (OPI) No. 166940/84, U.S. Pat. No. 3,958,995, Japanese Patent Application (OPI) Nos. 142339/80, 126027/79, 155835/79, 30328/78 and 92274/79; polyvinyl pyridinium salts as described in U.S. Pat. Nos. 2,548,564, 3,148,061, and 3,756,814; water-soluble quaternary ammonium salt polymers as described in U.S. Pat. No. 3,709,690; and water-insoluble quaternary ammonium salt polymers as described in U.S. Pat. No. 3,898,088 can be used.

As cationic polyelectrolyte, to reduce adverse influences exerted on the silver halide emulsion layer before development, water-soluble polymer latexes represented by formula (I) are preferably used.

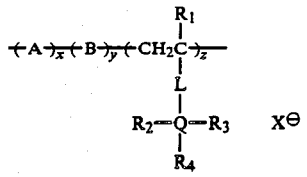

(I)

wherein

A represents a repeating unit resulting from copolymerization of a copolymerizable monomer containing at least two ethylenically unsaturated groups;

B represents a repeating unit resulting from copolymerization of an ethylenically unsaturated monomer copolymerizable with the monomers forming A and the other repeating unit;

$R_1$ represents a hydrogen atom or a lower alkyl group having from 1 to 6 carbon atoms;

L is a divalent group having from 1 to about 12 carbon atoms;

$R_2$, $R_3$, and $R_4$ (which may be the same or different) each represents an alkyl group having from 1 to about 20 carbon atoms, or an aralkyl group having from 7 to about 20 carbon atoms; or two of $R_2$, $R_3$, and $R_4$ combine together in combination with Q to form a ring structure;

$X^{\ominus}$ represents an anion except for an iodide ion;

x is about from 0.2 to 15 mol%;

y is from 0 to about 90 mol%;

z is from about 5 to 99 mol%.

Copolymerizable monomers containing at least two (preferably from 2 to 4) ethylenically unsaturated groups, which constitute the monomer unit represented by A in formula (I), include esters, amides, olefins, and aryl compounds.

Typical examples of the copolymerizable monomer containing at least two ethylenically unsaturated groups are ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allyl methacrylate, allyl acrylate, dialyl phthalate, methylenebisacrylamide, methylenebismethacrylamide, trivinyl cyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylidenediammonium dichloride, N,N'-bis(vinylbenzyl)-triethylenediammonium dichloride, N,N,N',N'-tetrabutyl-N,N'-bis(vinylbenzyl)-ethylenediammonium dichloride, and the like. Of these compounds, divinylbenzene and trivinylcyclohexane are particularly preferred from the viewpoint of, e.g., hydrophobic and antialkali properties.

A can be formed using two or more of the above monomers.

B is a monomer unit resulting from copolymerization of an ethylenically unsaturated monomer copolymerizable with A and the other repeating unit. Typical examples of the ethylenically unsaturated monomer are olefins (e.g., ethylene, propylene, 1-butene, vinyl chloride, vinylidene chloride, isobutene, and vinyl bromide), dienes (e.g., butadiene, isoprene, and chloroprene), ethylenically unsaturated esters of fatty acids or aromatic carboxylic acids (e.g., vinyl acetate, allyl acetate, vinyl propionate, vinyl butyrate, and vinyl benzoate), esters of ethylenically unsaturated acids (e.g., methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benxzyl acrylate, dibutyl maleate, diethyl fumarate, ethyl crotonate, and dibutyl methylenemaloate), styrenes (e.g., styrene, α-methylstyrene, vinyltoluene, chloromethylstyrene, chlorostyrene, dichlorostyrene, and bromostyrene), and unsaturated nitriles (e.g., acrylonitrile, methacrylonitrile, allyl cyanide, and crotonitrile). Of these compounds, styrenes and methacrylic acid esters are particularly preferred from a viewpoint of emulsion polymerizability.

B can be formed using two or more of the above monomers.

$R_1$ is a hydrogen atom, or a lower alkyl group having from 1 to about 6 carbon atoms. From a viewpoint of polymerization reactivity, a hydrogen atom or a methyl group is preferred.

L is a divalent group having from 1 to about 12 carbon atoms. In particular, divalent groups represented by the following formulae are preferred.

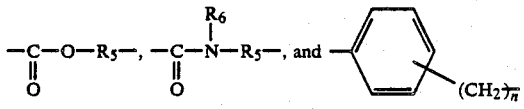

From the viewpoint of, e.g., anti-alkali properties, the following are more preferred.

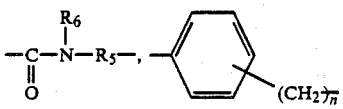

From the viewpoint of emulsion polymerizability, the following is preferred.

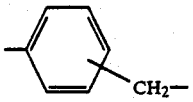

In the above formulae, $R_5$ is alkylene (e.g., methylene, ethylene, trimethylene, and tetramethylene), arylene, or aralkylene (e.g.,

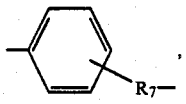

wherein $R_7$ is alkylene having from 0 to about 6 carbon atoms), $R_6$ is a hydrogen atom or $R_2$, and n is 1 or 2.

Q is N or P. From a viewpoint of toxity of the starting material, N is preferred over P.

$X^{\ominus}$ is an anion except for an iodide ion. Typical examples of the anion are halogen ions (e.g., chlorine ion and bromine ion), alkyl sulfuric acid ions (e.g., methylsulfuric acid ion and ethylsulfuric acid ion), alkyl or arylsulfonic acid ions (e.g., methanesulfonic acid ion, ethanesulfonic acid ion, benzenesulfonic acid ion, and p-toluenesulfonic acid), acetic acid ion, sulfuric acid ion, and nitric acid ion. Of these ions, a chlorine ion, alkylsulfuric acid ions, arylsulfonic acid ions, and a nitric acid ion are particularly preferred.

$R_2$, $R_3$, and $R_4$ which may be the same or different and are each an alkyl group having from 1 to about 20 carbon atoms, or an aralkyl group having from 7 to about 20 carbon atoms. These alkyl and aralkyl groups include substituted alkyl and aralkyl groups. $R_2$, $R_3$, and $R_4$ may combine together with each other or in combination with Q to form a ring structure.

Typical examples of the unsubstituted alkyl group include a methyl group, an ethyl group, a propyl group, an isopropyl group, a tert-butyl group, a hexyl group, a cyclohexyl group, 2-ethylhexyl group, and a dodecyl group. Typical examples of the substituted alkyl group are an alkoxyalkyl group (e.g., a methoxymethyl group, a methoxyethyl group, a butoxyethyl group, and a vinyloxyethyl group), a cyanoalkyl group (e.g., 2-cyanoethyl group and a 3-cyanopropyl group), a halogenated alkyl group (e.g., a 2-fluoroethyl group, 2-chloroethyl group, and a perfluoropropyl group), an alkoxycarbonylalkyl group (e.g., an ethoxycarbonylmethyl group), an allyl group, a 2-butenyl group, and a propagyl group.

Typical examples of the unsubstituted aralkyl group include a benzyl group, a phenetyl group, a diphenylmethyl group, and a naphthylmethyl group. Typical examples of the substituted aralkyl group are an alkylaralkyl group (e.g., a 4-methylbenzyl group, a 2,5-dimethylbenzyl group, a 4-isopropylbenzyl group, and a 4-octylbenzyl group), an alkoxyaralkyl group (e.g., 4-methoxybenzyl group, a 4-pentafluoropropenyloxybenzyl group, and a 4-ethoxybenzyl group), a cyanoaralkyl group (e.g., a 4-cyanobenzyl group and a 4-(4-cyanophenyl)benzyl group), a halogenated aralkyl group (e.g., a 4-chlorobenzyl group, a 3-chlorobenzyl group, a 4-bromobenzyl group, and a 4-(4-chlorophenyl)benzyl group.

The number of carbon atoms in the alkyl group is preferably from 1 to 12, and the number of carbon atoms in the aralkyl group is preferably from 7 to 14 carbon atoms.

A typical example of the ring structure formed when $R_2$, $R_3$, and $R_4$ combine together in combination with Q is the formula

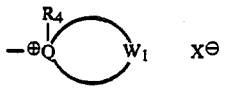

wherein $W_1$ is an atomic group forming an aliphatic heterocyclic ring in combination with Q, and typical examples of the aliphatic heterocyclic ring include:

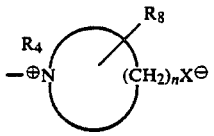

(wherein $R_8$ is a hydrogen atom or $R_4$, and n is an integer of from 2 to 12),

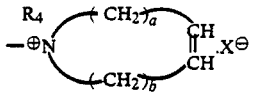

(a+b=integer of 2 to 7).

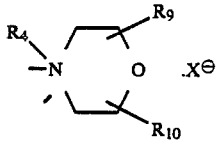

(wherein $R_9$ and $R_{10}$ are each a hydrogen atom, or a lower alkyl group having from 1 to 6 carbon atoms), and

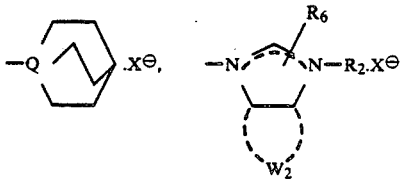

(wherein $W_2$ may be absent, or presents an atomic group forming a benzene ring);

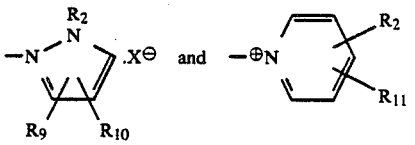

(wherein $R_{11}$ is a hydrogen atom,

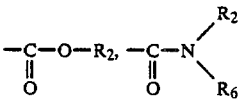

or $R_2$, and when two $R_2$'s are present, they may be the same of different).

Of the above ring structures, the following are preferred.

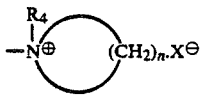

(wherein n is an integer of from 4 to 6), and

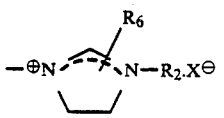

In the above formulae, $R_2$, $R_4$, $R_6$, Q, and $X^{\ominus}$ are the same as defined in formula (I).

The other repeating unit component may be formed of two or more mixed components.

x is from about 0.2 to about 15 mol%, and preferably from 1.0 to 10 mol%.

y is from 0 to about 90 mol%, and preferably from 20 to 60 mol%.

z is from about 5 to 99 mol%, preferably from 20 to 80 mol%, and especially preferably from 30 to 70 mol%.

Polymer latexes represented by formula (I) can be prepared by the method described in pages 7 to 9 of the specification of Japanese Patent Application (OPI) No. 202539/82.

Typical examples of the cationic polymer electrolytes that can be used are shown below.

I-1

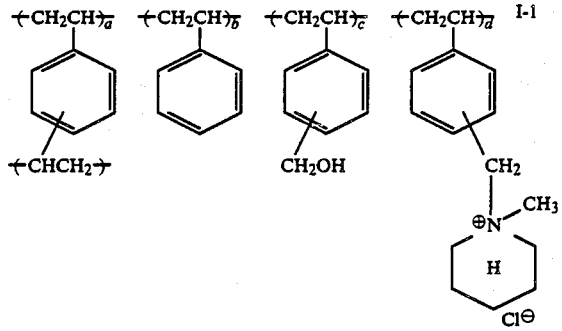

a/b/c/d = 5/47.5/5/42

I-2

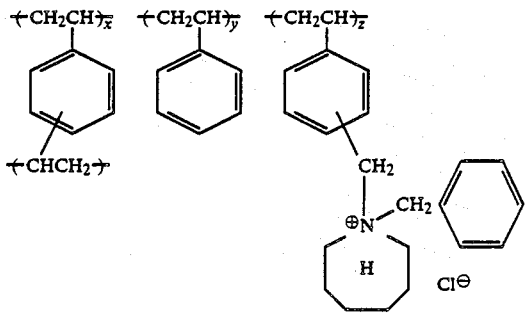

x/y/z = 5/47.5/47.5

I-3

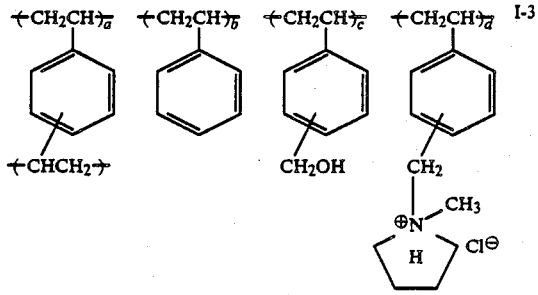

a/b/c/d = 2/38/10/50

I-4

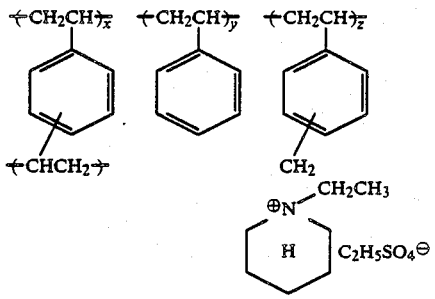

x/y/z = 1/49/50

I-5

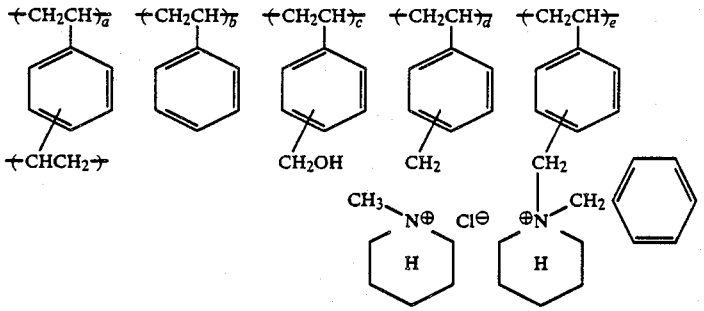

a/b/c/d/e = 5/47/5/30/13

I-6

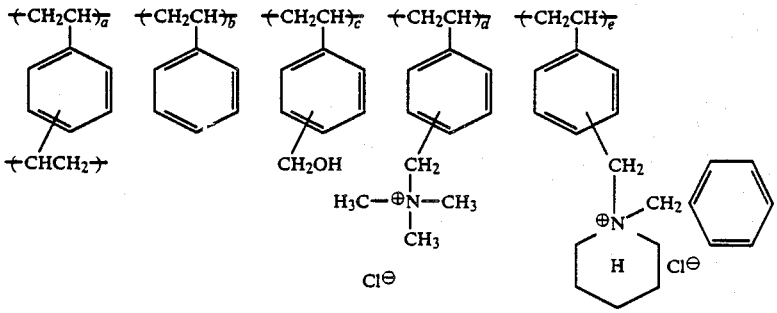

a/b/c/d/e = 5/47/5/13/30

-continued
I-7
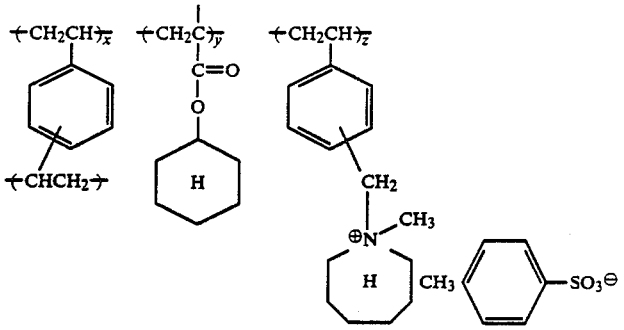
x/y/z = 2/63/35
I-8
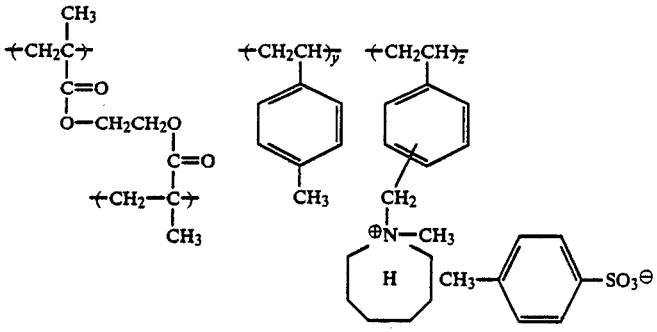
x/y/z = 3/57/40
I-9
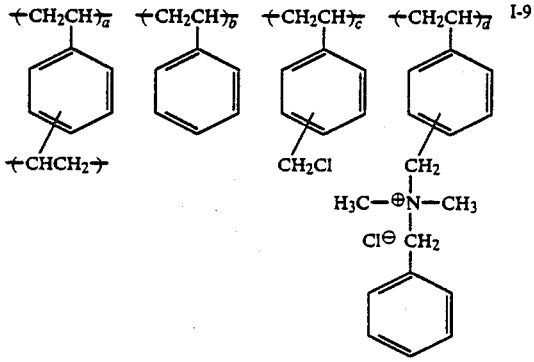
a/b/c/d = 2/49/4.9/44.1
I-10
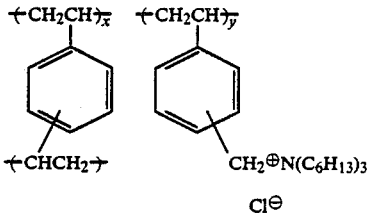
x/y = 5/95
I-11
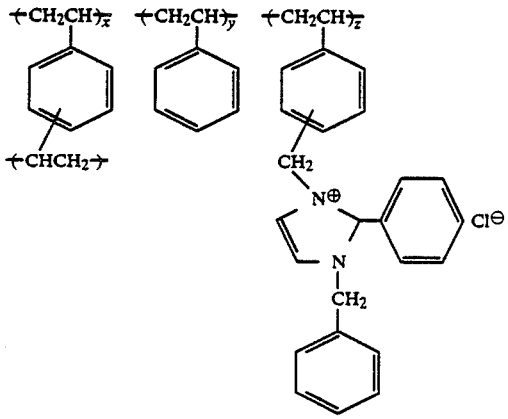
x/y/z = 3/56/41
I-12
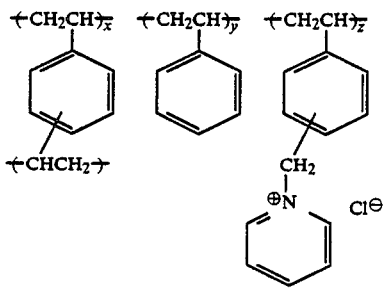
x/y/z = 2/38/60

-continued

I-13

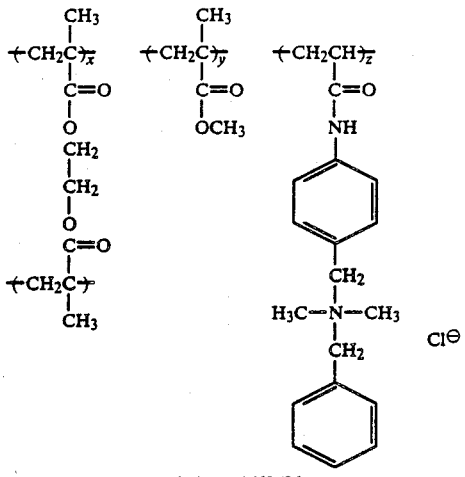

x/y/z = 4/60/36

I-14

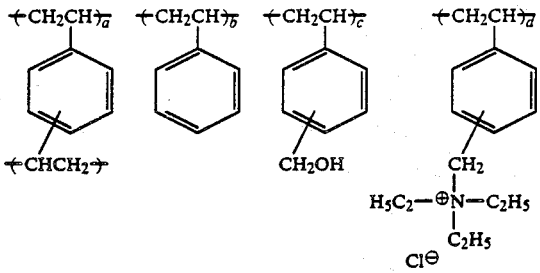

a/b/c/d = 2/49/5/44

I-15

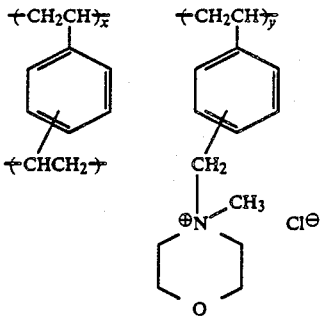

x/y = 5/95

I-16

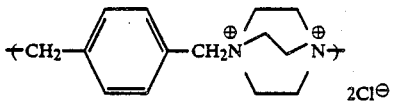

I-17

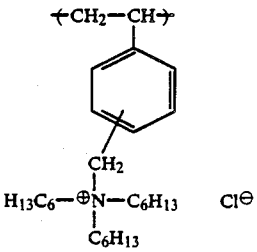

When the cationic polyelectrolyte the present invention is a water-soluble polymer latex, it is dispersed in a suitable colloid substance, such as agar, albumin, casein, collodion, cellulose-type substances (e.g., polyvinyl alcohol), or linear polyamides (e.g., polyhexamethylenedipiamide).

Another example of the layer capable of trapping iodide ions is a light-insensitive silver halide emulsion layer wherein the weight ratio of silver to a binder is from about ¼ to 1/100 and the amount of silver coated is about 0.5 g/m$^2$ or less.

The average particle size of the silver halide in the light-insensitive emulsion is preferably from 0.25 to 1.60 μm and more preferably from 0.30 to 1.00 μm.

The coating thickness of the light-insensitive silver halide emulsion layer is from about 0.5 to 5 μm and preferably from about 0.7 to 3 μm, in dry thickness.

The light-insensitive emulsion layer preferably contains gelatin. In this case, the weight ratio of silver to gelatin is from about ¼ to 1/100, preferably from 1/6 to 1/150, and more preferably from ⅛ to 1/30.

The amount of silver contained in the light-insensitive emulsion layer is generally from 0.03 to 0.5 g/m$^2$, preferably from 0.05 to 0.3 g/m$^2$, and more preferably from 0.07 to 0.2 g/m$^2$.

Examples of the silver halide include silver iodobromide, silver bromide, silver chloroiodobromide, and silver chlorobromide. A preferred example thereof is silver iodobromide having a silver iodide content of from 0.5 to 20 mol%.

The light-insensitive silver halide emulsion layer is made of an emulsion containing silver halide particles and a binder. Binders such as gelatin, as described in *Research Disclosure*, RD No. 17463, page 26, "Vehicles and Vehicle Extenders" (December 1978) can be used.

The "substantial light-insensitivity" of silver halide is the light-insensitive emulsion layer means that the sensitivity is 1/5 or less of the sensitivity of a light-sensitive emulsion layer. The sensitivity is measured as follows. A product having coated thereon a light-sensitive emulsion or light-insensitive emulsion in an amount of 0.5 g/m$^2$, calculated as Ag, and a coating thickness of 3 μm is prepared. The coated product is light exposed and then treated by D-19 at 20° C. for 5 minutes to obtain the characteristic curve. The sensitivity is measured from the exposure amount which provides a density of a fog density +0.1.

The light-insensitive silver halide emulsion layer of the present invention is made of an emulsion containing silver halide particles and a vehicle. Usually, vehicles such as gelatin, as described in *Research Disclosure*, RD No. 17643, page 26, "Vehicles and Vehicle Extenders" (December 1978) can be used. In the case of gelatin, it is used in such an amount that the weight ratio of silver halide to gelatin is from 2/1 to 1/12, and preferably from 1/1 to 1/10. The light-sensitive silver halide emulsion layer is provided so that the amount of silver halide (calculated as silver) is from 0.3 to 3.0 g/m$^2$, preferably from 0.3 to 1.5 g/m$^2$ and more preferably from 0.3 to 1.0 g/m$^2$.

The terminology "silver halide emulsion containing silver iodide" is used herein to mean a silver halide emulsion containing iodide ion as the silver halide $\alpha$-halogen composition. Examples are a silver iodobromide emulsion and a silver iodochlorobromide emulsion. The silver iodide content of the silver halide is preferably from 0.5 to 15 mol%, and especially preferably from 3 to 10 mol%.

In connection with silver halide particles, the average particle diameter is preferably from 0.5 to 3.0 $\mu$m, and especially preferably from 0.7 to 2.5 $\mu$m, and the crystal form may be regular such as cubic and octahedral, irregular such as spherical and plate-like, or in a composite form thereof. A mixture of particles having varied crystal forms may be used. These silver particles may be of the structure that the phase is different between the inside portion and the surface layer, or may be homogeneous in phase through the whole thereof. Furthermore, silver halide particles in which a latex image is formed mainly on the surface thereof, or particles in which a latent image is formed mainly in the inside thereof can be used. Silver halide particles of the type that a latent image is formed mainly on the surface thereof are preferably used.

The silver halide-containing emulsion that is used in the present invention can be prepared by methods as described, for example, in P. Glafkides, *Chemie et Physique Photographique*, particularly Chapters XVII to XXXIII, Paul Montel (1967); G. F. Duffin, *Photographic Emulsion Chemistry*, particularly Chapter IV, The Focal Press (1966); and V. L. Zelikman et al., *Making and Coating Photographic Emulsion*, particularly Chapters I, II, III, V, VI and VII, The Focal Press (1964). The silver halide emulsion may be subjected to chemical sensitization, spectral sensitization, or supersensitization, if desired. Antifoggants, hardening agents, development accelerators, surfactants, antistatic agents, and the like which are commonly used can be added to the silver halide emulsion. It is also useful that a protective layer is provided on the light-sensitive layer to protect the light-sensitive layer from physical damage, and also that a finely divided matting agent is added to the protective layer to improve sliding properties of the surface thereof and to prevent adhesion of the surface thereof.

In order to reduce the interaction prior to processing between the light-sensitive silver halide emulsion layer and the layer for trapping an iodide ion, a layer made mainly of, e.g., gelatin, polyvinyl alcohol, polyacrylamide, partially hydrolyzed polyvinyl acetate, a copolymer of $\beta$-hydroxyethyl methacrylate and ethyl acrylate, or acetyl cellulose may be provided between the two layers. As other major components for preparation of such layers, materials for a neutralization-timing layer as described, for example, in U.S. Pat. Nos. 3,455,686, 3,421,893, 3,785,815, 3,847,615 and 4,009,030, and Japanese Patent Application (OPI) No. 14415/77 can be used.

The diffusion transfer method is well known in the art and thus its detailed explanation is omitted. If necessary, see, for example, A. Tott and E. Weyde, *Photographic Silver Diffusion Transfer Processes*, The Focal Press, London (1972); C. B. Neblette, *Handbook of Photography and Reprography*, 7th Ed., Van Nostrand Reinhold (1977), Chapter 12, "One Step Photography"; and Haist, *Modern Photographic Processing*, Vol. 2, Chapter 8 "Diffusion Transfer", John Wiley & Sons (1979).

Many types of photographic materials can be prepared by the diffusion transfer method. That is, it is known that when a light-sensitive element comprising a support coated with a light-sensitive layer containing a silver photographic emulsion is superposed on an image-receiving element comprising a support coated with an image-receiving layer containing a silver-precipitating agent, and then an alkaline processing composition, such as a high or low viscosity alkaline processing composition containing a developing agent and a silver halide solvent is extended between the above two elements, a transferred silver image can be obtained. This type of photographic material is advantageously used in the practice of the present invention.

Silver halide developing agents which are suitably used in the present invention include benzene derivatives in which the benzene nucleus is substituted with at least two hydroxyl groups and/or an amino group in the ortho- or paraposition thereof, such as hydroquinone, amidole, methole, glycine, p-aminophenol, and pyrogallol, and hydroxylamindes, particularly primary and secondary aliphatic, or aromatic N-substituted or $\beta$-hydroxylamines, which are soluble in aqueous alkalis, such as hydroxylamine, N-methylhydroxylamine, and N-ethylhydroxylamine, compounds as described in U.S. Pat. No. 2,857,276 granted to Edwin H. Land on Oct. 21, 1958, and N-alkoxyalkyl-substituted hydroxylamines as described in U.S. Pat. No. 3,293,034 granted to Milton Green et al. on Dec. 20, 1966.

Hydroxylamine derivatives containing a tetrahydrofurfuryl group as described in Japanese Patent Application (OPI) No. 88521/74 can be used.

Aminoreductones as described in West German Patent Application (OLS) Nos. 2,009,054, 2,009,055, and 2,009,078, and heterocyclic aminoreductones as described in U.S. Pat. No. 4,128,425 can be used.

Tetraalkylreductinic acids as described in U.S. Pat. No. 3,615,440 can be used.

The above developing agents can be used in combination with phenidone compounds, p-aminophenol compounds, and ascorbic acid as auxiliary developing agents.

Various types of processing compositions can be used in the present invention. It is preferred for the processing composition to contain a developing agent, a silver halide solvent, and an alkali agent. Depending on the purpose of use, the developing agent and/or the silver halide solvent may be incroporated in the light-sensitive element and/or the image-receiving element.

Silver halide solvents which are suitable for use in the present invention include conventional fixing agents such as sodium thiosulfate, sodium thiocyanate, ammonium thiosulfate, and compounds as described in U.S. Pat. No. 2,543,181, and cyclic imide/nitrogen base combinations, such as compounds in which bartituric acid or uracil and ammonia or amine are combined together, and compounds as described in U.S. Pat. No. 2,857,274 granted to Edwin H. Land on Oct. 21, 1958.

In addition, 1,1-bissulfonylalkanes and their derivatives are known, and can also be used as the silver halide solvent of the present invention.

The processing composition contains alkalis, preferably alkali metal hydroxides, such as sodium hydroxide and potassium hydroxide. In a case where the processing composition is applied in a thin layer form between the superposed light-sensitive and image-receiving elements, it is preferred for the processing composition to contain a polymer film-forming agent, a thickening agent, or a tackifier. Particularly useful for this purpose are hydroxyethyl cellulose and sodium carboxymethylcellulose. These compounds are added to the processing composition in such a concentration that is effective to impart a suitable viscosity by the known principle of the diffusion transfer photographic method.

The processing composition may further contain additives known in the silver salt diffusion transfer method, such as antifoggants, toning agents, and stabilizers.

The present invention preferably uses an image-receiving layer made of regenerated cellulose containing a silver-precipitating agent.

The image-receiving element including an image-receiving layer is described below in detail.

The image-receiving element comprises a support bearing thereon a layer of regenerated cellulose containing a silver-precipitating agent. This support includes a baryta paper, a polyethylene-laminated paper, a triacetate film, and a polyester film. This image-receiving element can be prepared by coating a solution of a suitable cellulose ester, such as cellulose diacetate, with a silver-precipitating agent dispersed therein on a support which has been provided with a subbing layer, if desired. The cellulose ester layer thus formed is hydrolyzed with alkali to change the cellulose ester in cellulose at least in the direction of depth. In a particularly useful example, one or more mercapto compounds suitable to improve the tone, stability, and other photographic properties of a transfer-red silver image are added to unhydrolyzed areas of the cellulose ester layer which contain a silver-precipitating agent and/or underlying unhydrolyzed cellulose ester, e.g., cellulose diacetate. These mercapto compounds are diffused from the location where they have been first placed during imbibition.

If desired, another hydrophilic polymer layer may be provided between the hydrolyzed cellulose ester layer containing a silver-precipitating agent and the underlying cellulose ester or partially hydrolyzed cellulose ester layer (which may be containing the above mercapto compound). Polymers which can be used in this hydrophilic polymer layer include gelatin, gelatin derivatives (e.g., phthalated gelatin), sugars (e.g., starch, galactomannan, gum arabic, hydroxyethyl cellulose, methyl cellulose, carboxymethyl cellulose, and hydroxypropyl cellulose), hydrophilic synthetic polymers (e.g., polyacrylamide, polymethylacrylamide, poly-N-vinyl pyrrolidone, and 2-hydroxyethyl methacrylate), and so forth.

Furthermore, if desired, an alkali-neutralizing agent layer may be provided. In such alkali-neutralizing agent layer, polymer acids as described, for example, in Japanese Patent Publication No. 33697/73 are used.

Suitable examples of the silver-precipitating agent include heavy metals such as iron, lead, zinc, nickel, cadmium, tin, chromium, copper, and cobalt, particularly noble metals such as gold, silver, platinum, and palladium. Other useful silver-precipitating agents are the sulfides and selenides of noble metals, particularly sulfides of mercury, copper, aluminum, zinc, cadmium, cobalt, nickel, silver, lead, antimony, bismuth, cerium, and magnesium, and selenides of lead, zinc, antimony, and nickel. The action of the silver-precipitating agent in the silver transfer method is described, for example, in U.S. Pat. No. 2,774,667 granted to Edwin H. Land on Dec. 18, 1956.

The image-receiving element may contain various additives such as a hardening agent, a fluorescent brightener, and a coating aid, if desired.

The light-sensitive element is imagewise exposed to light by a conventional procedure. For this exposure, any of the known light sources such as natural light (sun light), a tungsten lamp, a fluorescent lamp, a mercury lamp, a xenon arc lamp, a carbon arc lamp, a xenon flash lamp, and a cathode ray tube flying spot can be used. The exposure time is, e.g., friom 1/1,000 second used in the ordinary camera to 1 second or longer. Of course, exposure of shorter than 1/1,000 second, for example, from $1/10^4$ to $1/10^6$ second using a xenon flash lamp or a cathode ray tube, and exposure of longer than 1 second can be applied. If desired, a color filter can be used to control the spectral composition of light for use in exposure. Laser light can be used for the purpose of exposure. Moreover, the light-sensitive element may be exposed to light emitted from a fluorescent body excited, for example, by an electron beam, X-rays, $\gamma$-rays, or $\alpha$-rays.

The light-sensitive material of the present invention has an advantage in that a photographic print obtained by photographic processing of the light-sensitive material, discoloration, or fading of a silver image scarcely occurs. Thus the light-sensitive material of the present invention is suitable for use in the preparation of a portrait for the purpose of identification and a micrograph, photographing of a CRT vision of an ultrasonic examination apparatus, and so forth.

The present invention is described in greater detail with reference to the following examples.

EXAMPLE 1

A solution of 30 g of gelatin, 330 ml of a 9 wt% aqueous solution of a polymer latex (Compound 1) of the present invention, and 640 ml of water was coated in a thickness of 130 ml/m$^2$ on a titanium dioxide-containing polyethylene terephthalate film provided with a subbing layer made of gelatin.

Silver halide particles were formed by the double jet method and then were subjected to physical ripening by the conventional procedure. They were then subjected to desalting treatment and then to chemical ripening to yield a silver iodobromide emulsion (iodide content: 6.5 mol%). The average diameter of the silver halide particles contained in the emulsion was 1.1 $\mu$m.

The above emulsion was dissolved at 40° C. To 1 kg of the emulsion (containing 0.6 mol of silver halide) were added 200 ml of a 0.02 wt% methanol solution of 3-{5-chloro-2-[2-ethyl-3-(3-ethyl-2-benzothiazolididene)propenyl]-3-benzoxazolio}propanesulfonate, 200 ml of a 0.02 wt% methanol solution of 4-{2-[(3-ethylbenzothiazolin-2-ylidene)-2-methyl-1-propenyl]-3-benzothiazolio}butanesulfonate, 100 ml of a 1 wt% aqueous solution of 4-hydroxy-6-methyl-1,3,3a,7-tetrazaindene, 10 ml of a 1 wt% methanol solution of lipoic acid, 40 ml of a 4 wt% aqueous solution of 2-hydroxy-1,3-bisvinylsulfonylpropane, and 14 g of an aqueous dispersion of polyethyl acrylate.

In addition, a gelatin solution added with a latex matting agent of polymethyl methacrylate was prepared.

This solution and the above emulsion were coated on the above polymer latex layer at the same time. The amount of silver in the coated silver halide was 0.60 g per square meter. The thickness of the layer of gelatin alone was 0.8 μm.

For the purpose of shielding light, a carbon black layer was coated on the opposite side of the support in relation to the silver halide emulsion layer to prepare a silver halide light-sensitive sheet of the present invention (Sheet 1-1).

EXAMPLE 2

A silver halide light-sensitive sheet (Sheet 1-2) was prepared in the same manner as in Example 1, except that a polymer latex (Compound 15) was used in place of the polymer latex (Compound 1).

EXAMPLE 3

For comparison, a silver halide light-sensitive sheet (Sheet 2-1) was prepared in the same manner as in Example 1, except that the layer of the polymer latex was omitted.

EXAMPLE 4

For comparison, a silver halide light-sensitive sheet (Sheet 2-2) was prepared in the same manner as in Example 1 except that 330 ml of water was used in place of 330 ml of the polymer latex.

Sheet 1-1, 1-2, 2-1 and 2-2 as prepared above were each exposed wedgewise by the use of a sensitometer with a light source of color temperature of 5,400° K. Each exposed light-sensitive sheet was superposed on an image-receiving sheet as prepared by the method described hereinafter. A processing solution having the formulation as described hereinafter was extended in a thickness of 0.05 mm between the light-sensitive and image-receiving sheets to achieve diffusion transfer development. On peeling apart the sheets from each other after 30 seconds, 3 minutes, or 5 minutes, a positive image was obtained.

Preparation of Image-Receiving Sheet

A mixture of 18 g of cellulose acetate (acetyl group content: 54%) and 12 g of a styrene-maleic anhydride copolymer was dissolved in a mixed solvent of 270 ml of acetone and 30 ml of methanol, and the solution thus prepared was then coated in a thickness of 54 ml/m$^2$ on a polyethylene-laminated paper which had been provided with a subbing layer on the both sides thereof. After the above coating was dried, an acetone solution of cellulose acetate containing 0.10% of 1-(4-N-hexylcarbamoylphenyl)-2,3-dihydroimidazole-2-thione was coated thereon in such an amount that the dry film thickness was 6.5 g/m$^2$. A 5% aqueous solution of dimethylolurea and a 50% aqueous solution of acetic acid were added to a 5% aqueous solution of polyacrylamide in proportions of 5% and 1.25%, respectively, and the resulting solution was coated on the above-formed layer in a thickness of 25 ml/m$^2$. Moreover, a fine dispersion of palladium sulfide in a solution of cellulose acetate in a mixed solvent of acetone and methanol was coated. To this dispersion was added 1-phenyl-5-mercaptoimidazole in such an amount that the amount of 1-phenyl-5-mercaptoimidazole coated was $1.25\times10^{-6}$ mole/m$^2$. The dry film thickness of 0.8 μm. An alkali solution as described hereinafter was coated on the above coating in an amount of 18 ml/m$^2$, washed with water and then dried, and thereafter a solution of a butyl methacrylate-acrylic acid copolymer (15/85 by mol) in a mixed solvent of methanol and acetone was coated in an amount of 15.8 g/m$^2$ and then dried.

On the opposite side of the polyethylene-laminated paper in relation to the above coating were successively coated the following layers to prepare an image-receiving sheet.

| | |
|---|---|
| Light-Shielding Layer: | |
| Carbon black | 8.0 g/m$^2$ |
| Gelatin | 4.0 g/m$^2$ |
| Formaldehyde | 0.02 g/m$^2$ |
| Trimethylolpropane | 2.0 g/m$^2$ |
| White Layer: | |
| Titanium dioxide | 10.0 g/m$^2$ |
| Gelatin | 1.5 g/m$^2$ |
| Trimethylolpropane | 0.45 g/m$^2$ |
| Protective Layer: | |
| Gelatin | 0.5 g/m$^2$ |
| Granulated polymethyl methacrylate | 0.3 g/m$^2$ |
| Formaldehyde | 0.02 g/m$^2$ |

The above palladium dispersion was prepared by adding a methanol solution of $7\times10^{-3}$ mol% of sodium sulfide and a methanol solution of $7\times10^{-3}$ mol% of sodium chloropalladium to a 5.3% solution of cellulose acetate in a mixed solvent of acetone and methanol and then thoroughly stirring them.

The composition of the above alkali solution was as follows:

| | |
|---|---|
| Potassium hydroxide (86%) | 25 g |
| Methanol | 400 ml |
| Water | 100 ml |
| Formulation of Processing Solution | |
| Potassium hydroxide (40% KOH, aqueous solution) | 323 ml |
| Titanium dioxide | 3 g |
| Hydroxyethyl cellulose | 79 g |
| Zinc oxide | 9.75 g |
| N,N—bis-methoxyethylhydroxyamine | 75 g |
| Triethanolamine solution (4.5 parts of triethanolamine to 6.2 parts of water) | 17.14 g |
| Tetrahydropyrimidinethione | 0.4 g |
| 2,4-Dimethylcaptopyrimidine | 0.35 g |
| Uracil | 90 g |
| Water | 1,193 g |

The positive image was measured for density by the use of a TCD-type automatic densitometer manufactured by Fuji Photo Film Co., Ltd.

This positive image sample was subjected to an accelerated deterioration test; that is, it was allowed to stand for 72 hours under conditions of 60° C. and 70% RH (Relative Humidity), and at 40° C. and 90% RH and then measured for density in the same manner as described above. In the case of the density prior to the accelerated deterioration test of 0.5, color fading and discoloration under the accelerated deterioration conditions are shown in Table 1.

TABLE 1

| Light-Sensitive Element (Sheet) | Peeling Time | Fading Value (Density just after Development: 0.5) 60° C. 70% RH Density After Accelerated Deterioration | Fading Value ($-\Delta D_{0.5}$) | 40° C. 90% RH Density After Accelerated Deterioration | Fading Value ($-\Delta D_{0.5}$) | Discoloration after 60° C. 70% RH and 40° C. 90% RH |
|---|---|---|---|---|---|---|
| 1-1 | 30 seconds | 0.50 | 0 | 0.48 | 0.02 | none |
| (Example of the | 3 minutes | 0.50 | 0 | 0.48 | 0.02 | none |
| Present Invention) | 5 minutes | 0.45 | 0.05 | 0.46 | 0.04 | none |
| 1-2 | 30 seconds | 0.49 | 0.01 | 0.49 | 0.01 | none |
| (Example of the | 3 minutes | 0.50 | 0 | 0.49 | 0.01 | none |
| Present Invention) | 5 minutes | 0.45 | 0.05 | 0.46 | 0.04 | none |
| 2-1 | 30 seconds | 0.48 | 0.02 | 0.47 | 0.03 | none |
| (Comparative | 3 minutes | 0.42 | 0.08 | 0.44 | 0.06 | none |
| Example) | 5 minutes | 0.36 | 0.14 | 0.36 | 0.14 | discolored |
| 2-2 | 30 seconds | 0.47 | 0.03 | 0.46 | 0.04 | none |
| (Comparative | 3 minutes | 0.42 | 0.08 | 0.44 | 0.06 | none |
| Example) | 5 minutes | 0.38 | 0.12 | 0.37 | 0.13 | discolored |

It can be seen from the results of Table 1 that the light-sensitive elements (1-2) and (1-2) of the present invention are reduced in fading of the image as determined under the forced deterioration test conditions as compared with the comparative light-sensitive element (2-1). Thus, it is apparent that the light-sensitive elements of the present invention are superior to the comparative light-sensitive element. The case is the same with the comparative light-sensitive element (2-2). Accordingly, it can be understood that the cationic polyelectrolyte of the present invention is effective in preventing fading and discoloration of the image.

EXAMPLE 5

Preparation of Emulsion Containing Substantially Light-Insensitive Silver Halide (Emulsion 1)

| | |
|---|---|
| Solution A (60° C.) | |
| Water | 600 cc |
| Gelatin | 16 g |
| KBr | 8 g |
| KI | 5.0 g |
| Solution B (50° C.) | |
| KBr | 70 g |
| Water | 300 cc |
| Solution C (50° C.) | |
| $AgNO_3$ | 100 g |
| Water | 300 cc |

The above Solutions B and C, while simultaneously stirring, were added to Solution A maintained at 60° C. over 30 minutes. The resulting mixture was subjected to physical ripening for 10 minutes, desalting treatment and then chemical ripening to obtain a silver iodobromide emulsion (iodine content: 5.1 mol%). The average particle diameter of the silver halide particles contained in the emulsion was 0.6 μm.

Preparation of Emulsion Containing Light-Sensitive Silver Halide (Emulsion 2)

| | |
|---|---|
| Solution A (70° C.) | |
| Water | 600 cc |
| Gelatin | 16 g |
| KBr | 20 g |
| KI | 6.3 g |
| Potassium thiocyanate | 1.8 g |
| Solution B (60° C.) | |
| KBr | 70 g |
| Water | 300 cc |
| Solution C (60° C.) | |

-continued

| | |
|---|---|
| $AgNO_3$ | 100 g |
| Water | 300 cc |

The above Solutions B and C, while simultaneously stirring, were added to the above Solution A maintained at 70° C. over 20 minutes. The resulting mixture was subjected to physical ripening for 10 minutes, desalting treatment and then chemical ripening to obtain a silver iodobromide emulsion (iodine content: 6.5 mol%). The average particle diameter of the silver halide particles contained in the emulsion was 1.20 μm.

Preparation of Light-Sensitive Layer Sheet

The above Emulsions 1 and 2 were dissolved at 40° C. To 1 kg of each emulsion (containing 0.65 mol of silver halide) were added 200 ml of a 0.02 wt% methanol solution of 3-{5-chloro-2-[2-ethyl-3-(3-ethyl-2-benzothiazolididene)propenyl]-3-benzoxazolio}propanesulfonate, 200 ml of a 0.02 wt% methanol solution of 4-{2-[(3-ethylbenzothiazolin-2-ylidene)-2-methyl-1-propenyl]-3-benzothiazolio}butanesulfonate, 100 ml of a 1 wt% aqueous solution of 4-hydroxy-6-methyl-1,3,3a,7-tetrazaindene, 10 ml of a 1 wt% methanol solution of lipoic acid, 40 ml of a 4 wt% aqueous solution of 2-hydroxy-1,3-bisvinylsulfonylpropane, and gelatin in an amount shown in Table 2.

The Emulsions 1 and 2 were coated on a support in the manner such that a layer of Emulsion 1 was provided between a layer of Emulsion 2 and the support. Further, a protective layer made of gelatin was also coated over the emulsion layers. The support was a white polyethylene terephthalate film having a subbing layer and also having coated on the side opposite to the emulsion layer a carbon black layer for shielding light.

Formation of Image

The light-sensitive layer sheet thus prepared was laminated with an image-receiving layer prepared below, and a treating composition shown below was extended therebetween in a thickness of 0.04 mm and diffusion transfer development was conducted to obtain a positive image.

A mixture of 22.4 g of cellulose acetate (acetyl group content: 55%) and 0.36 g of 3,6-diphenyl-1,4-dimercapto-3H, 6H-2,3a,5,6a-tetrazapentane was dissolved in a mixed solution of 179 ml of acetone and 45 ml of methanol, and the resulting solution was coated on a polyethylene-laminated paper in a thickness of 50 ml/m$^2$ and then dried. A solution prepared by dissolving 24 g of gum arabic into a mixed solution of 297 ml of water and 297 ml of methanol and further adding 6 ml of 6% formaldehyde solution thereto was coated thereon in a thickness of 27.1 ml/m$^2$ and dried. A solution prepared by dissolving 17.4 g of cellulose acetate into a mixed solution of 653 ml of acetone and 69 ml of methanol was further coated thereon in a thickness of 44 ml/m$^2$ and dried.

An alkali solution containing nickel sulfide as a silver precipitating agent was coated on the coated product prepared above in a thickness of 25 ml/m$^2$, dried, washed with water and then dried to prepare an image-receiving layer. The alkali solution had the following compositions.

| | |
|---|---|
| NaOH | 20 g |
| $H_2O$ | 200 ml |
| Methanol | 800 ml |
| Glycerin | 30 g |
| NiS | 0.06 g |

The silver precipitating agent contained in the alkali solution, i.e., nickel sulfide, was prepared by reacting 20% nickel nitrate aqueous solution and 20% nickel sulfide aqueous solution in glycerin while sufficiently strirring.

The treating solution had the same composition as described above.

The reflection density of the positive image sample obtained by diffusion transfer treatment was measured using TCD-type automatic densitometer manufactured by the Fuji Photo Film Co., Ltd. and the sensitivity was calculated from an exposure amount which provides a chemical density of 0.6. The sensitivity of Sample No. 8 was employed as 100 and the relative values thereof were indicated.

The image was subjected to an accelerated deterioration test for 7 hours under the conditions of 60° C. and 70% RH. In the case of the optical density immediately after the test of 0.50, the extent of image deterioration was evaluated by the variation of the optical density.

The results obtained are shown in Table 2 below.

The amount of gelatin in Emulsions 1 and 2 was adjusted so that the thickness of the emulsion layer became 3 μm in the silver content of 0.5 g/m$^2$, and each emulsion was coated on a white polyethylene terephthalate film. After exposure, the coated product was subjected to development (D-19, 20° C., 5 minutes) to determine the sensitivity. The sensitivity of Emulsion 1 was 1/20 the sensitivity of Emulsion 2.

TABLE 2

| Sample No. | Light-Insensitive Layer: Amount of Silver (g/m$^2$) | Amount of Gelatin Coated (g/m$^2$) | Silver/Gelatin | Immediately After Treatment: Maximum Density | Sensitivity | Extent of Image Deterioration $D_{0.5}$ |
|---|---|---|---|---|---|---|
| 1 (Invention) | 0.1 | 2.0 | 1/20 | 1.69 | 100 | 0.01 |
| 2 (Invention) | 0.1 | 1.0 | 1/10 | 1.71 | 99 | 0.02 |
| 3 (Invention) | 0.3 | 2.1 | 1/7 | 1.75 | 96 | 0.01 |
| 4 (Invention) | 0.3 | 1.5 | 1/5 | 1.77 | 94 | 0.02 |
| 5 (Comparison) | 0.1 | 0.3 | 1/3 | 1.78 | 80 | 0.05 |
| 6 (Comparison) | 0.6 | 12 | 1/20 | 1.36 | 105 | 0.01 |
| 7 (Comparison) | 0.7 | 6 | 1/10 | 1.48 | 102 | 0.02 |
| 8 (Comparison) | — | 1.0 | — | 1.45 | 105 | 0.06 |
| 9 (Comparison) | — | — | — | 1.68 | 100 | 0.08 |

The sample having an optical density of 0.50 was stored for 7 days under the conditions of 60° C. and 70% RH. The decrease of the optical density after storage is indicated.

The amount of silver in the light-sensitive layer was 0.55 g/m$^2$ and the amount of gelatin therein was 4.0 g/m$^2$.

Sample Nos. 1 to 4 (Invention) had a high maximum density and sensitivity, and small decrease of density when storing the image. On the other hand, Sample No. 5 (Comparison) had a large decrease of density.

Further, Sample Nos. 6, 7 and 8 (comparison) had a low maximum density. Sample No. 9, which did not contain a light-insensitive layer, had a large decrease of density.

While the invention had been described in detail and with reference to specific embodiments thereof, it will be apparent to one skilled in the art that various changes and modifications can be made therein without departing from the spirit and scope thereof.

What is claimed is:

1. In a method for forming an image by silver salt diffusion transfer where an imagewise exposed silver halide photographic element is superposed on an image-receiving element containing a silver-precipitating agent and then an alkaline processing solution containing a solvent for silver halide is introduced between the light-sensitive and image-receiving elements in the presence of a developing agent, the improvement wherein the imagewise exposed silver halide photographic element comprises a support and a light-sensitive silver halide emulsion containing silver iodide provided on the support, further comprising at least one layer capable of trapping iodide ions which is a layer of light-insensitive silver iodobromide having a silver iodide content of from 0.5 to 20 mol% provided between the support and light-sensitive silver halide emulsion layer.

2. A method as in claim 1, wherein the silver iodobromide layer for trapping iodide ions is a silver iodobromide emulsion layer wherein the weight ratio of silver to binder is from about 1/4 to 1/100 and the amount of silver in the coated silver halide is about 0.5 g/m$^2$ or less.

3. A method as in claim 1, wherein said light-insensitive silver iodobromide layer has a sensitivity 1/5 or less the sensitivity of the light-sensitive silver halide emulsion layer.

4. In a method for forming an image by silver salt diffusion transfer where an imagewise exposed silver halide photographic element is superposed on an image-receiving element containing a silver-precipitating agent and then an alkaline processing solution containing a solvent for silver halide is introduced between the light-sensitive and image-receiving elements in the presence of a developing agent, the improvement wherein the imagewise exposed silver halide photographic element comprises a support and a light-sensitive silver halide emulsion layer containing silver iodide provided on the support, and at least one layer capable of trapping iodide ions is provided between the support and the light-sensitive silver halide emulsion layer, wherein said layer capable of trapping iodide ions is a layer containing a cationic polyelectrolyte which does not contain iodide ions as counter ions.

5. A method as in claim 4, wherein said layer capable of trapping iodide ions contains a compound represented by formula (I):

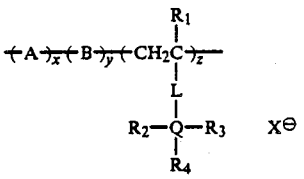

(I)

wherein:

A represents a repeating unit resulting from copolymerization of a copolymerizable monomer containing at least two ethylenically unsaturated groups;

B represents a repeating unit resulting from copolymerization of an ethyleneically unsaturated monomer copolymerizable with the monomer forming A and the other repeating unit;

$R_1$ represents a hydrogen atom or a lower alkyl group having from 1 to 6 carbon atoms;

L is a divalent group having from 1 to about 12 carbon atoms;

$R_2$, $R_3$ and $R_4$ each represents an alkyl group having from 1 to about 20 carbon atoms, or an aralkyl group having from 7 to about 20 carbon atoms; or two of $R_2$, $R_3$ and $R_4$ combine together in combination with Q to form a ring structure;

Q represents N or P;

$X^{\ominus}$ represents an anion except for an iodide ion;

x is from about 0.2 to 15 mol%;

y is from 0 to about 90%; and z is from about 5 to 99 mol%.

6. A method as claimed in claim 5, wherein x is from 1.0 to 10 mol%, y is from 20 to 60 mol% and z is from 30 to 70 mol%.

* * * * *